United States Patent [19]

Wright

[11] 4,171,272

[45] Oct. 16, 1979

[54] TURBINE LUBRICANT

[75] Inventor: R. Martin Wright, Cherry Hill, N.J.

[73] Assignee: FMC Corporation, Philadelphia, Pa.

[21] Appl. No.: 856,866

[22] Filed: Dec. 2, 1977

[51] Int. Cl.[2] ..... C10M 1/48; C10M 3/42; C10M 5/24; C10M 7/46

[52] U.S. Cl. ..... 252/46.7; 252/48.2; 252/49.9; 252/50; 252/78.5; 252/406; 252/407

[58] Field of Search ..... 252/46.7, 49.9, 48.2, 252/50, 406, 407, 78.5

[56] References Cited

U.S. PATENT DOCUMENTS

| | | | |
|---|---|---|---|
| 2,413,852 | 1/1947 | Turner | 252/49.9 |
| 2,605,226 | 7/1952 | Vaughn | 252/49.9 |
| 2,730,499 | 1/1956 | Pokorny | 252/49.8 |
| 2,779,739 | 1/1957 | Spivack | 252/49.8 |
| 2,842,497 | 7/1958 | Watson | 252/49.9 |
| 2,934,500 | 4/1960 | Cantrell et al. | 252/49.9 |
| 3,414,618 | 12/1968 | Randell | 260/576 |
| 3,553,131 | 1/1971 | Hepplewhite et al. | 252/46.7 |
| 3,790,478 | 2/1974 | Rudston et al. | 252/34 |
| 3,926,823 | 12/1975 | Durr et al. | 252/49.9 |
| 3,931,022 | 1/1976 | Chesluk et al. | 252/49.9 |
| 3,931,023 | 1/1976 | Dounchis | 252/49.8 |
| 3,992,307 | 11/1976 | Hotten | 252/49.9 |
| 3,992,309 | 11/1976 | Dounchis | 252/50 |

FOREIGN PATENT DOCUMENTS

| | | |
|---|---|---|
| 978932 | 12/1975 | Canada . |
| 2152892 | 4/1973 | France . |
| 1370728 | 10/1974 | United Kingdom . |

*Primary Examiner*—Delbert E. Gantz
*Assistant Examiner*—Irving Vaughn
*Attorney, Agent, or Firm*—Robert W. Kell; Frank Ianno

[57] ABSTRACT

A turbine lubricant having outstanding oxidation stability, corrosion resistance and good viscosity stability is based on an alkyl phenyl phosphate ester and contains small amounts of benzotriazole, a mixed mono- and dialkylphosphate of the formula $RH_2PO_4$ and $R_2HPO_4$, wherein R is an alkyl group of 8–12 carbon atoms, and an antioxidant selected from the group consisting of:

(a) a $C_{12}$ to $C_{18}$ alcohol ester of 3,3'-thiodipropionic acid;

(b) pentaerythritol tetra(3,5-di-tert-butyl-4-hydroxyphenyl)propionate, and (c) 4,4'-thiobis-(3-methyl-6-tert-butylphenol).

10 Claims, No Drawings

TURBINE LUBRICANT

This invention relates to lubricants especially adapted to the lubrication of gas turbines and, in particular, steam turbines employed in naval and other marine use where severe conditions conducive to corrosion are encountered. Though especially designed for use in gas turbines, the lubricants of the invention because of their excellent stability at high temperatures, are particularly suitable for use in all applications wherein high use temperatures are routinely encountered and where rusting conditions are present.

The use of triaryl phosphate esters as lubricants is known and is described in French Pat. No. 2,152,892 and U.S. Pat. No. 3,931,023. These patents also describe certain additives, which improve the oxidation and corrosion characteristics of phosphate ester lubricants, when present in small amonts.

The use of small quantities of phenyl $\alpha$- or $\beta$-naphthylamines to improve the oxidation characteristic of lubricants is taught in U.S. Pat. Nos. 2,730,499; 3,553,131; 2,413,852; 3,414,618; 2,779,739 and 2,842,497.

Other additives sometimes present in lubricating oils are the known corrosion inhibitors sometimes referred to as copper pacifiers. The use of benzotriazole as a lubricant additive is taught in U.S. Pat. Nos. 3,790,478, 3,931,022, 3,707,500, 3,926,823 and French Pat. No. 2,152,892.

The use of phosphate esters derived from $C_8$–$C_{12}$ alcohols (ORTHOLEUM 162) as a lubricant additive is described in U.S. Pat. Nos. 2,605,226, 2,779,739, 3,931,023, and French Pat. No. 2,152,892.

No single additive package, however, has been entirely satisfactory in the lubrication of modern gas turbines, because the lubricant comes in contact with condensed steam and, at times, even with sea water due to leaks in the condensing and cooling systems. The lubricant must separate successfully from the water without the formation of troublesome emulsions and must be stable to protect the metal surfaces of the turbines from corrosion, even under these severe conditions. Corrosion protection is needed by those parts that are wetted by the oil. The lubricant must not foam to any substantial extent. Also, for commercial reasons, the lubricant should be entirely homogeneous and free from suspended matter and compatible with other additives such as those additives which improve the load-carrying ability of the lubricant.

The problem of thermal stability in turbine lubricants may be handled by the use of specific alkylphenyl/phenyl phosphate base stocks, which generally also have low temperature properties, being fluid at temperatures of −40° C. or below. A more difficult problem, however, is that of oxidation stability and resistance to corrosion which arises owing to the fact that the lubricants have to operate at high oil temperatures (about 200° C.) in contact with air. These conditions have the effect of greatly accelerating the oxidative deterioration of the lubricant, which generally results in an increase in its viscosity and acidity, and corrosion of or formation of deposits on metal surfaces. Excessive increases in viscosity may result in restricted flow of lubricant to the engine bearings, resulting in less than adequate lubrication on starting. A decrease in lubricant viscosity, on the other hand leads to a different problem which arises because a lubricant of low viscosity is very thin and lacks "body" under the high temperature operating conditions.

Alkyl substituted triarylphosphates in which the alkyl group contains a 3° benzylic hydrogen, as typified by the isopropylphenyl moiety, are susceptible to oxidative degradation due to attack on the 3° benzylic hydrogen. This process is accentuated by elevated temperatures such as occurs in turbine and other operating machinery.

Numerous oxidation and corrosion inhibitors have been found for use in lubricating compositions and many combinations thereof have also been tested. In many instances, the effect of such combination is merely the additive effect of each of the inhibitors employed. In other cases, synergism is exhibited between the additives used, thus promoting to an unaccountable degree the oxidation and corrosion protection of the composition. It is impossible to predict, however, just which classes of inhibitors will be effective synergists until such combinations have actually been tested and found to be advantageous. Moreover, the results obtained in a particular chemical class of lubricating base is not indicative of the results to be expected in other organic media. For example, a class of oxidation or corrosion inhibitor which is effective in mineral oil may be substantially ineffective, or even act as a pro-oxidant, when utilized in an ester type oleaginous fluid. Likewise, synergizing parts or sets of additives which are effective for the purpose in mineral oil may have little or no advantage where employed in ester lubricants.

It is an object of the invention to provide a formulated lubricant composition containing a unique combination of additives which impart properties that meet various performance specifications. More specifically, an object of the present invention is to stabilize alkyl phenyl phosphate lubricants such as tricresyl phosphate with small amounts of additives to meet the oxidation, corrosion and rust inhibitory limits required by recognized standards.

The compositions of the present invention pass the ASTM-D 892 antifoam test. The volume of foam at the end of a 5-minute blowing period is less than 25 ml.

The compositions of the present invention pass the ASTM Rusting Test D 665-IP 135, 24 hours with distilled water (Part A) and 24 hours with synthetic sea water (Part B).

The corrosive properties of the compositions of the present invention are such that when tested by Federal Test Method Standard No. 791B, Method 5308.6, the change in weight of the steel, silver, aluminum alloy and magnesium alloy squares is no greater than plus or minus 0.2 milligram per square centimeter of surface and the change in weight of the copper square is no greater than plus or minus 0.4 milligram per square centimeter of surface.

When tested as specified in ASTM Test D 445, the viscosity of the composition of the present invention does not change more than plus 15% or minus 5% from the original 160° F. viscosity and the total acid number does not increase more than 2.0 mg KOH/g (ASTM Test D-974).

Now, in accordance with the present invention, it has been found that despite the known susceptability to oxidation and viscosity changes of a liquid mixed isopropylphenyl/phenyl phosphate, such phosphate esters and other alkyl phenyl phosphate esters such as tricresyl phosphate can be stabilized to an outstanding degree by the incorporation therein of small amounts of benzotriazole, a mixed mono- and dialkylphosphate of the formula $RH_2PO_4$ and $R_2HPO_4$, wherein R is an alkyl group of 8–12 carbon atoms, and an antioxidant selected from the group consisting of:

(a) a $C_{12}$ to $C_{18}$ alcohol ester of 3,3'-thiodipropionic acid;

(b) pentaerythritol tetra(3,5-di-tert-butyl-4-hydroxyphenyl)propionate, and (c) 4,4'-thiobis-(3-methyl-6-tert-butylphenol).

Throughout this specification, the additive concentration is expressed as percent by weight and is based on the alkyl phenyl phosphate base stock.

Preferably the additives may be present in the following amounts:

| | |
|---|---|
| the $C_{12}$ to $C_{18}$ alcohol ester of 3,3'-thiodipropionic acid; | 0.05–0.2 wt. % |
| pentaerythritol tetra(3,5-di-tert-butyl-4-hydroxyphenyl)propionate; | 0.025–0.1 wt. % |
| 4,4'-thiobis-(3-methyl-6-tert-butyl phenol); | 0.0025–0.5 wt. % |
| benzotriazole; | 0.01–0.1 wt. % |
| mixed mono- and dialkyl phosphates of the formula $RH_2PO_4$ and $R_2HPO_4$ wherein R is an alkyl group of 8–12 carbon atoms | an effective amount up to about 0.1 wt. % |

The liquid mixed isopropylphenyl/phenyl phosphate base oil employed in the present invention may be conveniently prepared as described in U.S. Pat. No. 3,576,923 by the alkylation of phenol with from about 10% to 40% by weight of propylene based on the weight of the phenol and phosphorylation of the alkylate. The weight ratio of the alkyl moiety to the phenol moiety in such a phosphorylated alkylphenol/phenyl ester mixture may range from 0.005 to 0.65. Suitable phosphate esters are those obtained by phosphorylation of an alkylate having the following analysis:

| | |
|---|---|
| phenol | 29–57.2 weight percent |
| 2-isopropylphenol | 27–39 weight percent |
| 3-isopropylphenol, 4-isopropylphenol | 9–14 weight percent |
| 2,6-diisopropylphenol | 2–5 weight percent |
| 2,4-diisopropylphenol | 3.5–8 weight percent |
| 2,5-diisopropylphenol, 3,5-diisopropylphenol | 0.3–2 weight percent |
| 2,4,6-triisopropylphenol | 0.4–2 weight percent |
| 2,3,5-triisopropylphenol | <1 weight percent |

Of particular advantage is a phosphate ester base stock obtained by phosphorylation of an alkylate having the following analysis:

| | |
|---|---|
| phenol | 44–50 weight percent |
| 2-isopropylphenol | 30–35 weight percent |
| 3-isopropylphenol, 4-isopropylphenol | 11–14 weight percent |
| 2,6-diisopropylphenol | 2–3 weight percent |
| 2,4-diisopropylphenol | 3.5–5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

The unexpected and remarkable benefits that can be achieved by the use of the additive combination of the present invention with such alkyl phenyl phosphate esters will be shown by the following examples.

EXAMPLE 1

A prototype gas turbine lubricant is prepared using as the base oil a liquid mixed isopropylphenyl/phenyl phosphate ester obtained by the phosphorylation of an alkylate having the following analysis:

| | |
|---|---|
| phenol | 44 weight percent |
| 2-isopropylphenol | 33 weight percent |
| 3-isopropylphenol, 4-isopropylphenol | 12.5 weight percent |
| 2,6-diisopropylphenol | 3 weight percent |
| 2,4-diisopropylphenol | 5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

To this base oil is added 0.001% by weight of a dimethyl silicone polymer antifoam composition (Antiform A manufactured by the Dow Chemical Co., Midland, Michigan); 0.1% by weight pentaerythritol tetra(3,4-di-tert-butyl-4-hydroxy-phenyl)propionate (Irganox 1010 manufactured by Ciba/Geigy, Ardsley, New York); 0.1% by weight dilauryl thiodipropionate (dilauryl 3,3'-thiodipropionate); 0.01 weight percent benzotriazole and 0.01 weight percent of a mixed mono- and dialkyl phosphate of the formua $RH_2PO_4$ and $R_2HPO_4$, wherein R is an alkyl group of 8–12 carbon atoms. (ORTHOLEUM 162 manufactured by E. I. DuPont de Nemours & Co., Wilmington, Delaware).

The lubricant so obtained passes the ASTM Rusting Test D 665-IP 135, 24 hours with distilled water (Part A) and 24 hours with synthetic salt water (Part B).

The lubricant of this example is evaluated by means of the 72 hours 175° C. "five metal" corrosion-oxidation stability test. This test, which is finding increasing use in the evaluation of high temperature lubricants and hydraulic fluids, is described in Federal Test Method Standard No. 791B, Method 5308.6 and is carried out as follows. Weighed, polished one-inch square specimens of copper, steel, aluminum, magnesium, and silver are tied together into a box, with the silver specimens as diagonals separating the copper and steel on one side and the aluminum and magnesium on the other. The box is immersed in 100 milliliters of the test oil in an oxidation tube fitted with a reflux condenser, and air is bubbled through at a rate of 5 liters an hour while the oil is maintained at 175° C. for the 72 hours. When the test period is completed, the oil and metals are examined for evidence of oxidative degradation—for example, a large increase or decrease in oil viscosity, a large increase in the acid number, a large deposition of sludge, and corrosive attack on one or more of the metal specimens. When tested in accordance with ASTM Test D-445, the viscosity change of this oil at 100° F. is +4.74 percent, well within specification, and the acid number by ASTM Test D-974 is 0.51 mg KOH/gm.

There is no change in the color of the lubricant or in the weight of the silver, magnesium alloy or aluminum alloys. There is an increase of 0.007 mg/cm$^2$ in the weight of the steel sample and a −0.102 mg/cm$^2$ weight change in the copper sample.

EXAMPLES 2–5

In Examples 2–5, the base oil is the same as that used in Example 1 and the amount and type of additives are varied as indicated in Table I. The effect of these changes on viscosity stability, acid number and corrosion is summarized in Table II.

EXAMPLE 6

Example 1 above is repeated except that the pentaerythritol tetra(3,4-di-tert-butyl-4-hydroxyphenyl)propionate is eliminated from the composition. The resulting turbine lubricant passed all of the tests discussed above in connection with Examples 1–5.

EXAMPLE 7

Example 1 above is repeated except that the dilauryl dithiodipropionate is eliminated from the composition. The resulting turbine fluid passed all of the tests discussed above in connection with Examples 1–5.

EXAMPLE 8

A prototype gas turbine lubricant is prepared using as the base oil a liquid mixed isopropylphenyl/phenyl phosphate ester obtained by the phosphorylation of an alkylate having the following analysis:

| | |
|---|---|
| phenol | 44 weight percent |
| 2-isopropylphenol | 33 weight percent |
| 3-isopropylphenol, 4-isopropylphenol | 12.5 weight percent |
| 2,6-diisopropylphenol | 3 weight percent |
| 2,4-diisopropylphenol | 5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

To this base oil is added 0.001% by weight of a dimethyl silicone polymer antifoam composition (Antifoam A manufactured by the Dow Chemical Co., Midland, Michigan); 0.01 percent by weight 4,4'-thiobis-(3-methyl-6-tert-butylphenol) (sold by the Monsanto Chemical Company, St. Louis, Mo., under the trade name SANTONOX); 0.1% by weight dilauryl thiodipropionate (dilauryl 3,3'-thiodipropionate); 0.01 weight percent benzotriazole and 0.01 weight percent of a mixed mono- and dialkyl phosphate of the formula $RH_2PO_4$ and $R_2HPO_4$, wherein R is an alkyl group of 8–12 carbon atoms (ORTHOLEUM 162 manufactured by E. I. DuPont de Nemours & Co., Wilmington, Delaware).

The lubricant so obtained passes the ASTM Rusting Test D 665-IP 135, 24 hours with distilled water (Part A) and 24 hours with synthetic salt water (Part B).

The lubricant of this example passes the Federal Test Method Standard No. 791B, Method 5308.6. When tested in accordance with ASTM Test D 445, the viscosity change at 100° F. is +11.11 percent, and the acid number is 1.44 mg KOH/gm (ASTM Test D-974).

There is no change in the color of the lubricant or in the weight of the steel, magnesium alloy or aluminum alloys. There is a decrease of 0.058 mg/cm$^2$ in the weight of the silver sample and a −0.160 mg/cm$^2$ weight change in the copper sample.

EXAMPLES 9–13

In Examples 9–13, the base oil is the same as that used in Example 8 and the amount and type of additives are varied as indicated in Table III. The effect of these changes on viscosity stability, acid number and corrosion is summarized in Table IV.

EXAMPLE 14

Example 8 above is repeated except that the dilauryl 3,3'-thiodipropionate is eliminated from the composition and the amount of SANTONOX is increased to 0.5 weight percent. The resulting turbine fluid passed all of the tests discussed above in connection with Examples 1–5.

The above examples are given in order to illustrate the remarkable improvement in properties of isopropylphenyl/phenyl phosphate esters achieved by employing the combination of additives described above and are not intended to be limiting, within the boundaries of the following claims.

TABLE I

| Weight Percent Of: | Examples[1] 1 | 2 | 3 | 4 | 5 |
|---|---|---|---|---|---|
| Pentaerythritol Tetra (3,4-di-tert-butyl-4-hydroxy)propionate | 0.1 | 0.05 | 0.025 | 0.01 | 0.1 |
| Diluaryl Thiodipropionate | 0.1 | 0.1 | 0.1 | 0.1 | |
| Benzotriazle | 0.01 | 0.01 | 0.01 | 0.01 | 0.01 |
| Mixed Alkyl Acid Orthophosphates[2] | 0.01 | 0.01 | 0.01 | 0.01 | 0.01 |
| Distearyl Thiopropionate | | | | | 0.1 |

[1]All Examples contain 0.001% antifoam.
[2]Having the general formula $RH_2PO_4$ and $R_2HPO_4$ wherein R is an alkyl group of 8–12 carbon atoms.

TABLE II

| | Acid Number mgKOH/gm | | Kinetic Viscosity cts. at 100° F. | | Percent Viscosity | FTMS 5308.6 72 Hours at 175° C. Corrosion-Oxidation Test mgs/cm$^2$ | | | | |
|---|---|---|---|---|---|---|---|---|---|---|
| Examples | Fresh | Oxid. | Fresh | Oxid. | Change | Copper | Steel | Magnesium | Aluminum | Silver |
| 1 | 0.10 | 0.51 | 28.49 | 29.84 | +4.74 | −0.102 | +0.007 | 0.000 | 0.000 | 0.000 |
| 2 | 0.09 | 0.79 | 28.59 | 30.46 | +6.54 | −0.087 | +0.007 | +0.029 | −0.015 | −0.058 |
| 3 | 0.21 | 1.26 | 28.76 | 30.32 | +5.42 | −0.095 | +0.029 | +0.015 | +0.029 | −0.015 |
| 4 | 0.13 | 0.94 | 28.56 | 29.68 | +3.92 | −0.087 | −0.007 | +0.015 | +0.007 | −0.022 |
| 5 | 0.11 | 0.99 | 28.86 | 31.67 | +9.74 | −0.102 | 0.000 | 0.000 | −0.007 | −0.022 |

TABLE III

| Weight Percent Of: | Examples[1] 9 | 10 | 11 | 12 | 13 |
|---|---|---|---|---|---|
| 4,4'-thiobis-(3-methyl-6-tert-butylphenol) | 0.01 | 0.025 | 0.05 | 0.005 | 0.0025 |
| Dilauryl Thiodipropionate | 0.1 | 0.1 | 0.1 | 0.1 | 0.1 |
| Benzotriazole | 0.01 | 0.01 | 0.01 | 0.01 | 0.01 |

TABLE III-continued

| Weight Percent Of: | Examples[1] 9 | 10 | 11 | 12 | 13 |
|---|---|---|---|---|---|
| Mixed Alkyl Acid Orthophosphates[2] | 0.01 | 0.01 | 0.01 | 0.01 | 0.01 |

[1]All Examples contain 0.001% antifoam.
[2]Having the general formula $RH_2PO_4$ and $R_2HPO_4$ wherein R is an alkyl group of 8-12 carbon atoms.

TABLE IV

| Examples | Acid Number mgKOH/gm Fresh | Oxid. | Kinetic Viscosity cts. at 100° F. Fresh | Oxid. | Percent Viscosity Change | FTMS 5308.6 72 Hours at 175° C. Corrosion-Oxidation Test mgs/cm2 Copper | Steel | Magnesium | Aluminum | Silver |
|---|---|---|---|---|---|---|---|---|---|---|
| 9 | 0.10 | 1.44 | 28.72 | 31.91 | +11.11 | −0.160 | 0.000 | 0.000 | 0.000 | −0.058 |
| 10 | 0.10 | 1.61 | 28.94 | 32.82 | +13.41 | −0.153 | −0.015 | −0.029 | −0.029 | −0.109 |
| 11 | 0.12 | 1.01 | 28.94 | 31.46 | +8.71 | −0.189 | −0.044 | −0.022 | −0.044 | −0.098 |
| 12 | 0.06 | 1.20 | 28.75 | 32.61 | +13.43 | −0.153 | −0.015 | −0.022 | −0.022 | −0.095 |
| 13 | 0.07 | 0.96 | 28.80 | 31.81 | +10.45 | −0.131 | −0.015 | −0.022 | −0.015 | −0.051 |

What is claimed is:

1. A fire resistant lubricant composition comprising a liquid mixed isopropylphenyl/phenyl phosphate base oil and in admixture therewith from about 0.01 to 0.1 weight percent benzotriazole; an effective amount not less than about 0.01 weight percent of a mixed mono- and dialkyl phosphate of the formula $RH_2PO_4$ and $R_2HPO_4$ wherein R is an alkyl group of 8-12 carbon atoms; and from about 0.0025 to about 0.2 weight percent of an antioxidant selected from the group consisting of a $C_{12}$ to $C_{18}$ alcohol ester of 3,3'-thiodipropionic acid; pentaerythritol tetra(3,5-di-tert-butyl-4-hydroxyphenyl)propionate, and 4,4'-thiobis-(3-methyl-6-tert-butylphenol).

2. The fire resistant lubricant composition of claim 1 wherein the antioxidant is a $C_{12}$ to $C_{18}$ alcohol ester of 3,3'-thiodipropionic acid.

3. The fire resistant lubricant composition of claim 1 wherein the antioxidant is pentaerythritol tetra(3,5-di-tert-butyl-4-hydroxyphenyl)propionate.

4. The fire reistant lubricant composition of claim 1 wherein the antioxidant is 4,4'-thiobis-(3-methyl-6-tert-butylphenol).

5. The lubricant composition of claim 2 wherein said alkyl phenyl/phenyl phosphate ester is obtained by phosphorylation of an alkylate having the following analysis:

| | |
|---|---|
| phenol | 44-50 weight percent |
| 2-isopropylphenol | 30-35 weight percent |
| 3-isopropylphenol, 4-isopropylphenol | 11-14 weight percent |
| 2,6-diisopropylphenol | 2-3 weight percent |
| 2,4-diisopropylphenol | 3.5-5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

6. The lubricant composition of claim 2 wherein the amount of 3,3'-thiodipropionic acid ester present is from about 0.05 to about 0.2 weight percent.

7. The lubricant composition of claim 3 wherein said alkyl phenyl/phenyl phosphate ester is obtained by phosphorylation of an alkylate having the following analysis:

| | |
|---|---|
| phenol | 44-50 weight percent |
| 2-isopropylphenol | 30-35 weight percent |
| 3-isopropylphenol, 4-isopropylphenol | 11-14 weight percent |
| 2,6-diisopropylphenol | 2-3 weight percent |
| 2,4-diisopropylphenol | 3.5-5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

8. The lubricant composition of claim 3 wherein the amount of pentaerythritol tetra(3,5-di-tert-butyl-4-hydroxyphenyl)propionate present is about 0.1 weight percent.

9. The lubricant of claim 4 wherein said alkyl phenyl/phenyl phosphate ester is obtained by phosphorylation of an alkylate having the following analysis:

| | |
|---|---|
| phenol | 44-50 weight percent |
| 2-isopropylphenol | 30-35 weight percent |
| 3-isopropylphenol, 4-isopropylphenol | 11-14 weight percent |
| 2,6-diisopropylphenol | 2-3 weight percent |
| 2,4-diisopropylphenol | 3.5-5 weight percent |
| 2,5-diisopropylphenol, 3,5-diisopropylphenol | <1 weight percent |
| 2,4,6-triisopropylphenol | <1 weight percent |
| 2,3,5-triisopropylphenol | <1 weight percent |

10. The lubricant composition of claim 4 wherein the amount of 4,4'-thiobis-(3-methyl-6-tert-butylphenol) present is 0.5 weight percent.

* * * * *

UNITED STATES PATENT AND TRADEMARK OFFICE

CERTIFICATE OF CORRECTION

PATENT NO. : 4,171,272

DATED : October 16, 1979

INVENTOR(S) : R. Martin Wright

It is certified that error appears in the above-identified patent and that said Letters Patent are hereby corrected as shown below:

Column 4, lines 14 and 15 "2,5-diisopropylphenol 3,5-diisopropylphenol" should read --2,5-diisopropylphenol, 3,5-diisopropylphenol} --; lines 20 and 21, "Anti-form" should read --Antifoam--; line 28, "formua" should read --formula--. Column 6, Table 1, line 4, "Diluaryl" should read --Dilauryl--; Table 1, line 5, "Benzotriazle" should read --Benzotriazole--. Column 7, Claim 4, line 1, "reistant" should read --resistant--.

Signed and Sealed this

*Twenty-second* Day of *January 1980*

[SEAL]

*Attest:*

SIDNEY A. DIAMOND

*Attesting Officer*

*Commissioner of Patents and Trademarks*